US008251030B2

(12) United States Patent
Schneiker

(10) Patent No.: US 8,251,030 B2
(45) Date of Patent: Aug. 28, 2012

(54) ROCKER COVER SYSTEM

(75) Inventor: John R. Schneiker, Muskego, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 391 days.

(21) Appl. No.: 12/508,387

(22) Filed: Jul. 23, 2009

(65) Prior Publication Data

US 2011/0017166 A1 Jan. 27, 2011

(51) Int. Cl.
*F01M 9/10* (2006.01)

(52) U.S. Cl. ..... 123/90.38; 123/90.39; 123/193.5; 123/195 C

(58) Field of Classification Search ..... 123/90.38, 123/90.39, 193.3, 193.5, 195 C
See application file for complete search history.

(56) References Cited

U.S. PATENT DOCUMENTS

| | | | | |
|---|---|---|---|---|
| 2,669,981 | A | 2/1954 | Leach | |
| 3,396,712 | A | 8/1968 | Sakraida et al. | |
| 3,589,346 | A * | 6/1971 | Warren et al. | 123/90.41 |
| 3,942,490 | A | 3/1976 | Scott | |
| 4,608,950 | A | 9/1986 | Payne et al. | |
| 4,709,670 | A * | 12/1987 | Ampferer | 123/195 C |
| 4,788,950 | A | 12/1988 | Finley | |
| 4,856,467 | A * | 8/1989 | Kronich | 123/90.43 |
| 5,095,860 | A | 3/1992 | Newell | |
| 5,492,086 | A | 2/1996 | Kuhns | |
| 5,553,583 | A | 9/1996 | Jones | |
| 5,636,607 | A | 6/1997 | Sattler et al. | |
| 5,642,701 | A * | 7/1997 | Oswald et al. | 123/193.5 |
| 5,645,025 | A | 7/1997 | Caya et al. | |
| 5,884,594 | A | 3/1999 | Wichle | |
| 6,302,074 | B1 | 10/2001 | Bolsover et al. | |
| 6,550,440 | B1 | 4/2003 | Vrsek et al. | |
| 6,952,056 | B2 | 10/2005 | Brandenburg et al. | |
| 6,975,216 | B2 | 12/2005 | Tharman et al. | |
| 6,998,725 | B2 | 2/2006 | Brandenburg et al. | |
| 7,051,695 | B1 | 5/2006 | Kowis | |
| 7,195,094 | B2 | 3/2007 | Street et al. | |
| 7,314,397 | B2 | 1/2008 | Sodemann et al. | |
| 7,316,215 | B1 | 1/2008 | Nino et al. | |
| 7,350,488 | B2 | 4/2008 | Harbert | |
| 7,430,999 | B2 | 10/2008 | Schweiger | |
| 7,441,525 | B2 | 10/2008 | Jessberger et al. | |

(Continued)

FOREIGN PATENT DOCUMENTS

DE 20 2006 011 816 U1 1/2008

(Continued)

OTHER PUBLICATIONS

Invitation to Pay Additional Fees and Related Search Report for PCT Application No. PCT/2010/041519, dated Nov. 22, 2010, 6 pages.
International Search Report and Written Opinion for Application No. PCT/US2010/041519, mail date Feb. 22, 2011, 15 pages.

*Primary Examiner* — Ching Chang
(74) *Attorney, Agent, or Firm* — Foley & Lardner LLP

(57) ABSTRACT

A cover system for an internal combustion engine having an overhead valve or overhead cam configuration includes a cover attached to a head plate. The cover has sides extending from a top surface and terminating in a flange with an overhang. The overhang includes a catch. The head plate has sides extending from a bottom surface and terminating in a curl. The flange and the overhang are positioned adjacent to the curl with the catch engaging an end of the curl.

9 Claims, 7 Drawing Sheets

U.S. PATENT DOCUMENTS

| | | | | |
|---|---|---|---|---|
| 7,677,578 | B2 * | 3/2010 | Taguchi | 277/592 |
| 2002/0112684 | A1 | 8/2002 | Jones et al. | |
| 2005/0061280 | A1 | 3/2005 | Jialanella et al. | |
| 2007/0012271 | A1 | 1/2007 | Hilpert | |
| 2007/0169734 | A1 | 7/2007 | Harbert | |
| 2007/0186889 | A1 | 8/2007 | Schweiger | |
| 2008/0093862 | A1 | 4/2008 | Brandenburg et al. | |
| 2008/0173273 | A1 | 7/2008 | Cunningham | |
| 2009/0173310 | A1 | 7/2009 | Sedlar et al. | |

FOREIGN PATENT DOCUMENTS

| | | | |
|---|---|---|---|
| DE | 10 2007 063 257 | A1 | 7/2009 |
| EP | 1 950 474 | A1 | 7/2008 |
| FR | 852 336 | A | 1/1940 |
| FR | 2 582 732 | A1 | 12/1986 |
| WO | WO 02/02914 | A1 | 1/2002 |

* cited by examiner

ROCKER COVER SYSTEM

BACKGROUND

The present invention relates generally to the field of small combustion engines with overhead valve or overhead cam configurations. More specifically the present invention relates to a system for covering rocker arms, valve stems, overhead cams, or other engine components extending from a cylinder head.

Overhead valve (OHV) engines include various components to open and close the intake and exhaust valves. Typically, a camshaft includes cams that push tappets at timed intervals. The tappets are coupled to pushrods, and the pushrods engage rocker arms. The rocker arms pivot upon spherical surfaces of a rocker balls, which are positioned on rocker studs and transfer the upward force of the pushrods into downward force on valve stems, and visa versa. Other rocker arms may pivot upon cylindrical pivots, such as pins, that are secured to a cylinder head without rocker studs. As the rocker arms push down or lift up upon the valve stems, the corresponding intake and exhaust valves open and close in the combustion chamber. Often valve springs are positioned around the valve stems to provide a lifting force to return the rocker arms and valves to the closed position when the cam is no longer engaged with the tappet.

The rocker arms and rocker studs are typically fastened to the top of a cylinder head, with the pushrods and valve stems extending through apertures in the cylinder head. The components of the OHV configuration extending from the top of the cylinder head are typically enclosed by a housing. A head plate forms a bottom portion of the housing. The head plate may be integrally formed with the cylinder head, or may be separately attached to bosses extending from the cylinder head. A rocker cover forms a top portion of the housing, attaching to the head plate and limiting access to the rocker arms and other components of the OHV configuration attached to the top of the cylinder head.

SUMMARY

One embodiment of the invention relates to a cover system for an internal combustion engine having an overhead valve or overhead cam configuration. The system includes a cover attached to a head plate. The cover has sides extending from a top surface and terminating in a flange with an overhang. The overhang includes a catch. The head plate has sides extending from a bottom surface and terminating in a curl. The flange and the overhang are positioned adjacent to the curl with the catch engaging an end of the curl.

Another embodiment of the invention relates to an internal combustion engine with an overhead valve configuration. The engine includes a cylinder head, an exhaust valve rocker stud with a threaded end, and an intake valve rocker stud with a threaded end. The engine further includes a head plate fastened to the cylinder head with the exhaust valve rocker stud and the intake valve rocker stud. The only threaded fasteners fastening the head plate to the cylinder head are the rocker studs.

Yet another embodiment of the invention relates to an internal combustion engine with an overhead valve configuration. The engine includes a cylinder head having mounting bosses extending from the cylinder head. Also the engine includes two rocker studs and a head plate fastened to the cylinder head via the rocker studs. Threaded ends of the rocker studs are fastened through apertures in the head plate to the bosses. Additionally, the engine includes a cover attached to the head plate without the use of threaded fasteners.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION OF THE EXEMPLARY EMBODIMENTS

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
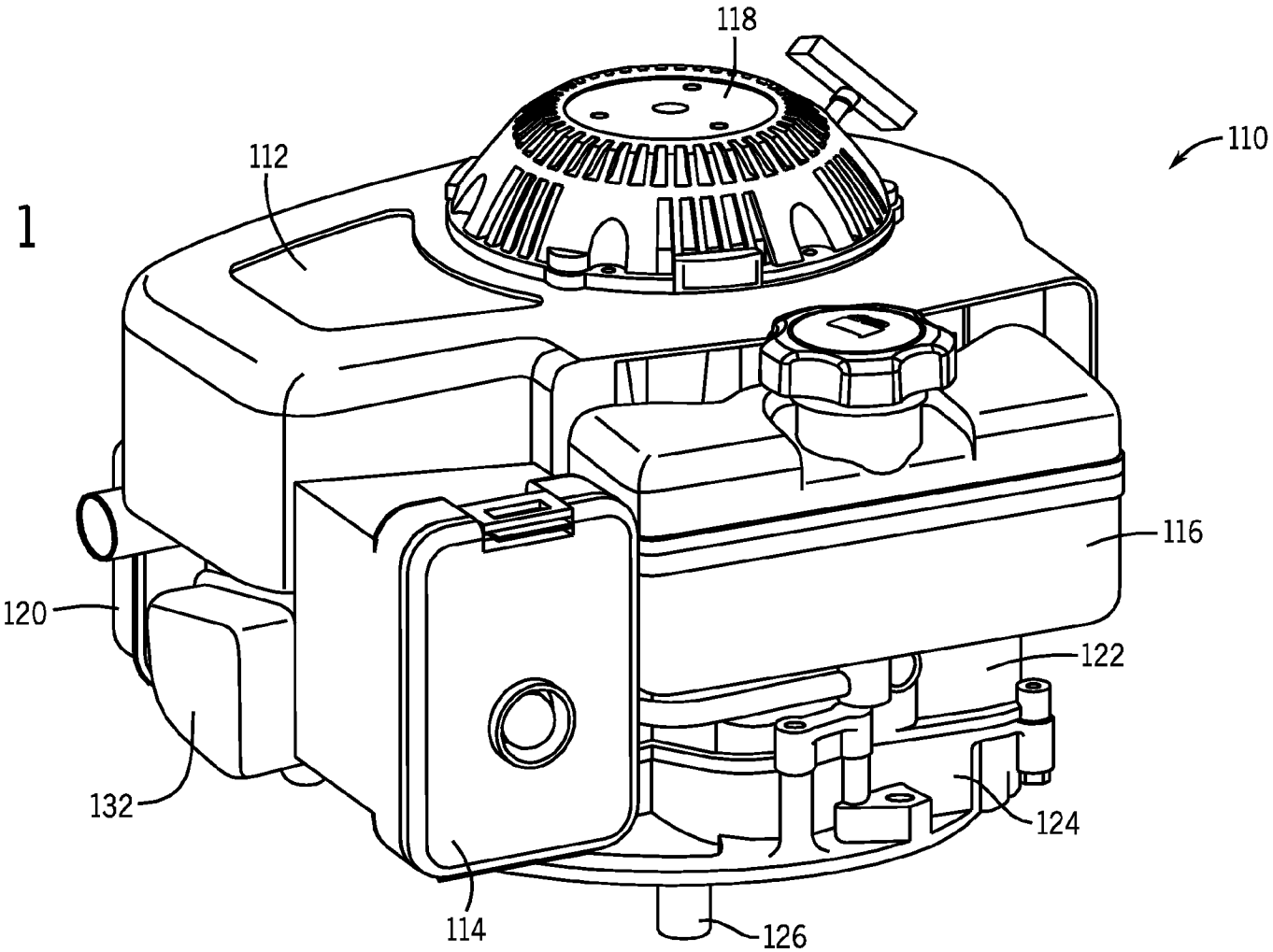
FIG. 1 is a perspective view of an internal combustion engine according to an exemplary embodiment.

Referring to FIG. 1, an internal combustion engine 110 includes a blower housing 112 covering a top of the engine 110, with an air intake 114 and a fuel tank 116 mounted to a side of the engine 110. A recoil starter 118 is attached to the top of the blower housing 112, and a muffler 120 is attached to one side of the engine 110. The engine 110 may include an automatic starter. The engine 110 may be used to drive power equipment, such as a rotary lawn mower blade, a pressure washer pump, a home generator, or other equipment.

The engine 110 further includes a crankcase 122 and a corresponding sump 124 fastened to the underside of the crankcase 122. The crankcase 122 supports internal components of the engine 110, such as a piston, a connecting rod, a camshaft, and other components. The sump 124 forms a base of the crankcase 122, and holds a pool of oil lubricant within the crankcase 122. A vertical crankshaft 126 extends from the crankcase 122, through the sump 124. The crankcase 122 and sump 124 may be integrally cast.

Figure 2:
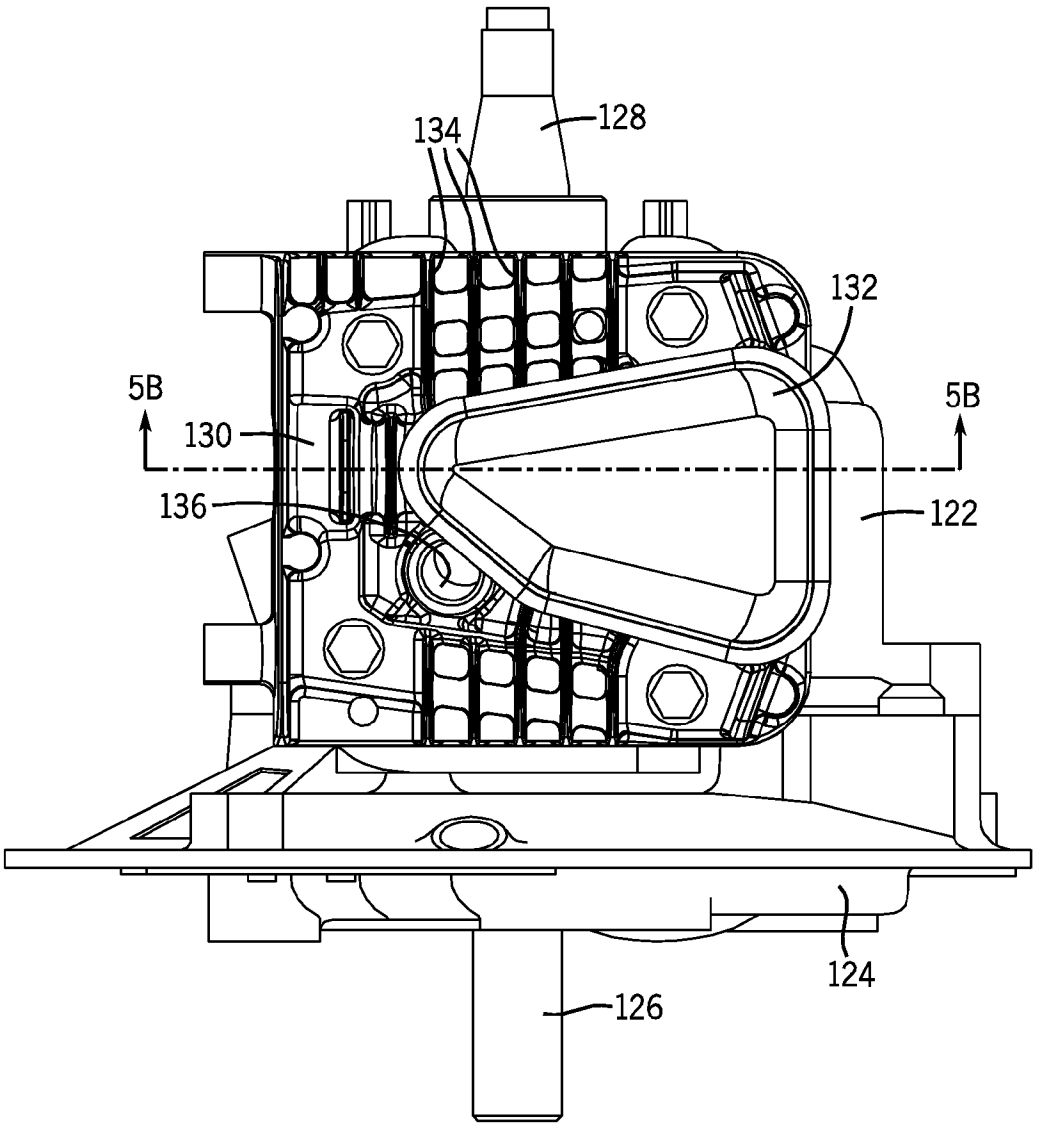
FIG. 2 is side view of a cylinder head and a crankcase according to an exemplary embodiment.

FIG. 2 shows a side view of the engine 110, with various engine components not shown to better display the engine structure. For example, the blower housing 112 is omitted to better show components on the top of the engine 110, including a top portion 128 of the crankshaft 126. The top portion 128 powers a flywheel and blower fan, and may be engaged by the recoil starter 118. A cylinder head 130 is attached to a cylinder block 250 (see FIG. 5A) and a rocker cover 132 is coupled to the cylinder head 130. The cylinder head 130 includes fins 134 for heat dissipation. Also shown in FIG. 2, the cylinder head 130 includes an aperture 136 through which a spark plug may be inserted to ignite fuel in the combustion chamber. The cylinder head 130 is fastened to the cylinder block 250 via bolts 140, or other fasteners. The rocker cover 132 is fastened to a head plate 138, as shown in FIG. 3.

Figure 3:
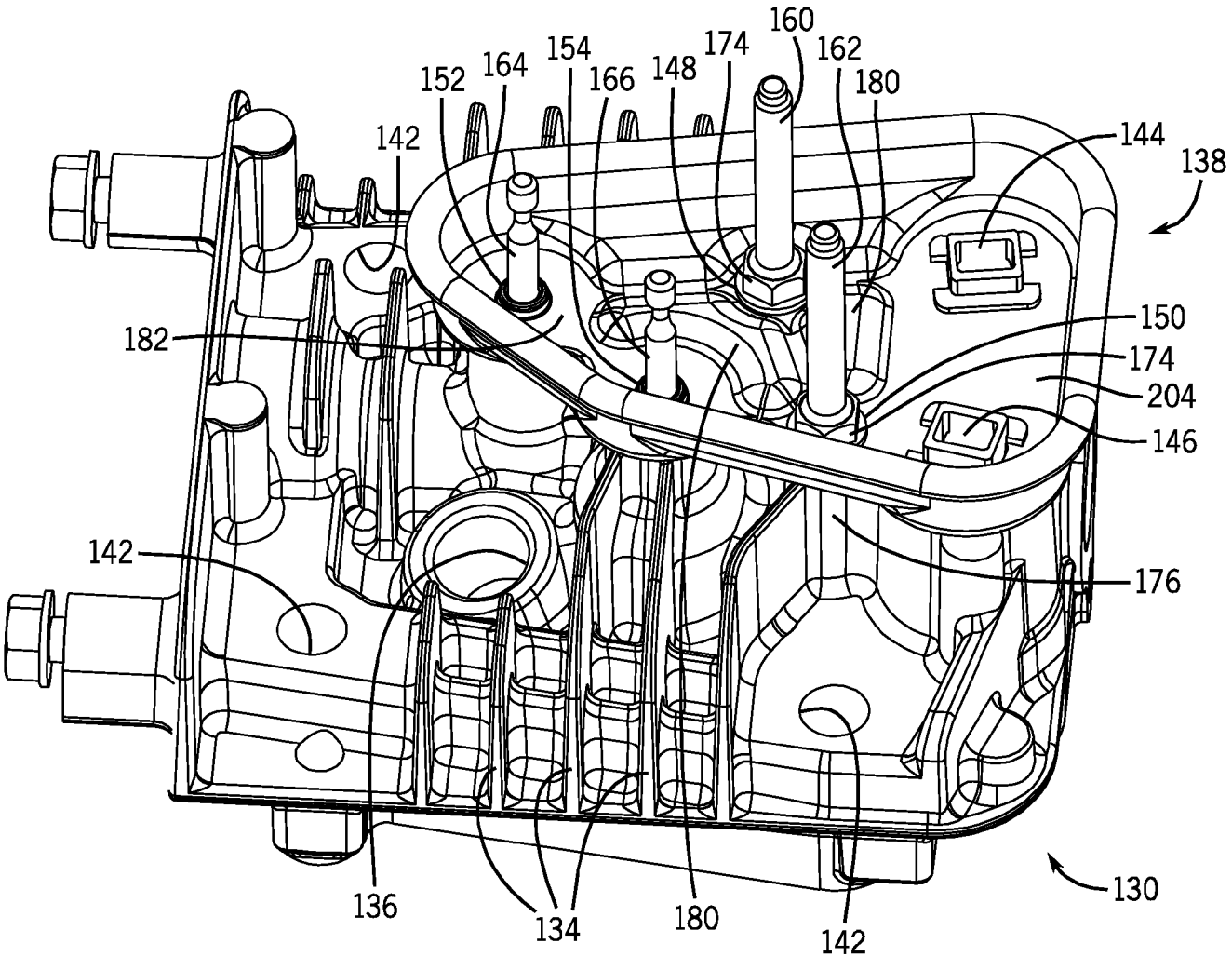
FIG. 3 is a perspective view of a cylinder head according to an exemplary embodiment.

FIG. 3 shows a perspective view of the cylinder head 130, including the fins 134, the spark plug aperture 136, and bolt holes 142 through which extend the bolts 140 that fasten the cylinder head 130 to the cylinder block 250. The head plate 138 is mounted to the top of the cylinder head 130. Also shown are the rocker studs 160, 162 and valve stems 164, 166 corresponding to rocker arms 168, 170 (see FIG. 4).

Referring to FIG. 3, the head plate 138 is coupled to the top of the cylinder head 130. The rocker studs 160, 162 include threaded ends 172 (see FIG. 5B) that are inserted through apertures 148, 150 in the head plate 138. Adjacent to the threaded ends and an intermediate body section, the rocker studs 160, 162 include a flange that doubles as a bolt head 174. The rocker studs 160, 162 are inserted through the apertures 148, 150 in the head plate 138, and into bosses 176 (see also FIG. 5B) extending from the cylinder head 130. According to an exemplary embodiment, the rocker studs 160, 162 are the only threaded fasteners used to couple the head plate 138 to the cylinder head 130. Valve stems 164, 166 are inserted through valve guides that pass through the head plate 138 and into the cylinder head 130, and thus provide support to the head plate 138 in directions transverse to the longitudinal axes of the valve stems 164, 166. Further support may be provided by a gasket 228 positioned between the head plate 138 and the cylinder head 130. For example, in some embodiments a liquid gasket (that solidifies or cures after application) is used, which also functions as an adhesive. In other embodiments, the head plate is integrally cast with the cylinder head. In still other embodiments, the head plate is welded to the cylinder head.

Referring to FIG. 3, the head plate 138 includes apertures 144, 146 for pushrods 156, 158 (see FIG. 4); apertures 148, 150 for rocker studs 160, 162; and apertures 152, 154 for exhaust and intake valve stems 164, 166, respectively. The apertures 144, 148, 152 are aligned, and the apertures 146, 150, 154 are aligned. Alignment allows the apertures 144, 148, 152 and 146, 150, 154 to support straight rocker arms 168, 170 (see FIG. 4). The apertures 144, 148, 152 are spaced further apart than the apertures 146, 150, 154, allowing the apertures 144, 148, 152 to support a longer rocker arm 168 than the apertures 146, 150, 154. For example, in some embodiments, the rocker arm 168 corresponding to the exhaust valve stem 164 is longer than the rocker arm 170 corresponding to the intake valve stem 166. In other embodiments, a head plate may include additional apertures configured to support other numbers of valves stems, rocker studs, and pushrods.

Still referring to FIG. 3, the bottom surface 204 of the head plate 138 includes a number of protrusions 180. The protrusions form wells 182 to support valve springs 184 (see FIG. 4). Additionally, the protrusions 180 strengthen portions of the head plate 138, preventing warping and deflection resulting from heat transferred from the cylinder head 130.

Figure 4:
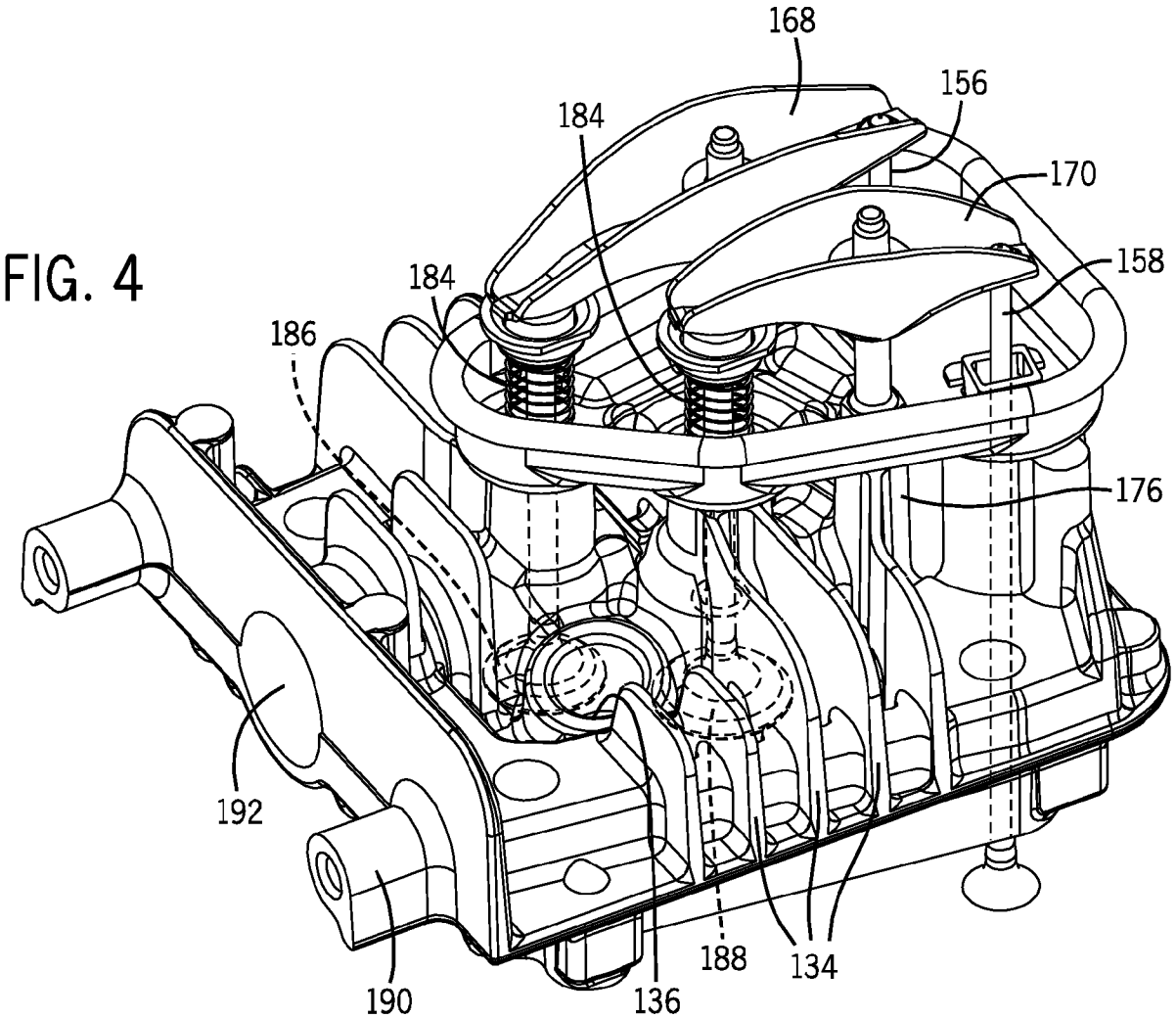
FIG. 4 is a perspective view of the cylinder head with rocker arms according to an exemplary embodiment.

FIG. 4 shows the cylinder head 130, with rocker arms 168, 170 attached. Also shown in FIG. 4 are mounting bosses 190 for attaching a muffler to the cylinder head 130. The muffler may be attached over an exhaust port 192, through which exhaust gases from the combustion chamber exit the cylinder head 130.

The rocker arms 168, 170 move at different times to transfer force from the pushrods 156, 158, opening and closing an exhaust valve 186 and an intake valve 188, respectively. The head plate 138 has an asymmetrical shape corresponding to the arrangement of the rocker arms 168, 170. However, in other embodiments the head plate 138 may be formed in other shapes and configurations.

Figure 5A:
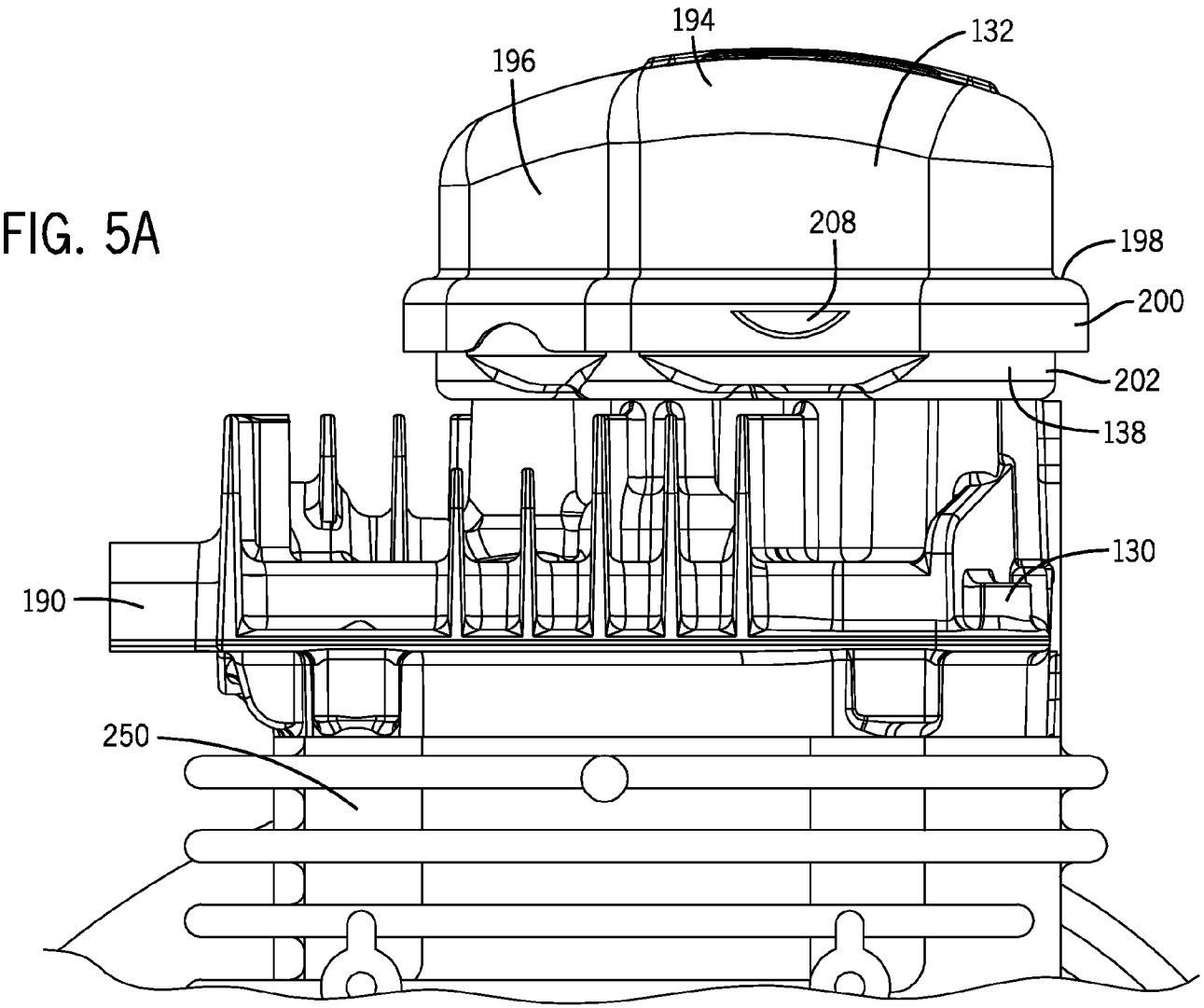
FIG. 5A is a side view of a cylinder head and rocker cover according to an exemplary embodiment.

FIG. 5A shows the rocker cover 132 mounted over the head plate 138, which is attached to the cylinder head 130. The rocker cover 132 includes a dome-shaped top surface 194 with sides 196 extending from the top surface. In other embodiments, the top surface is flat or otherwise shaped. The sides 196 are rounded into the top surface 194, reducing sharp edges with corresponding stress and heat concentrations. Proximate to the end of the sides 196, the rocker cover includes a flange 198 with an overhang 200 extending below the flange 198. In some embodiments, the rocker cover 132 is formed from steel sheet. However, in other embodiments the rocker cover 132 is formed from other materials, such as aluminum, molded plastic with composite fiber, or other materials. Sides 202 of the head plate 138 extend from the bottom surface 204 of the head plate 138.

Figure 5B:
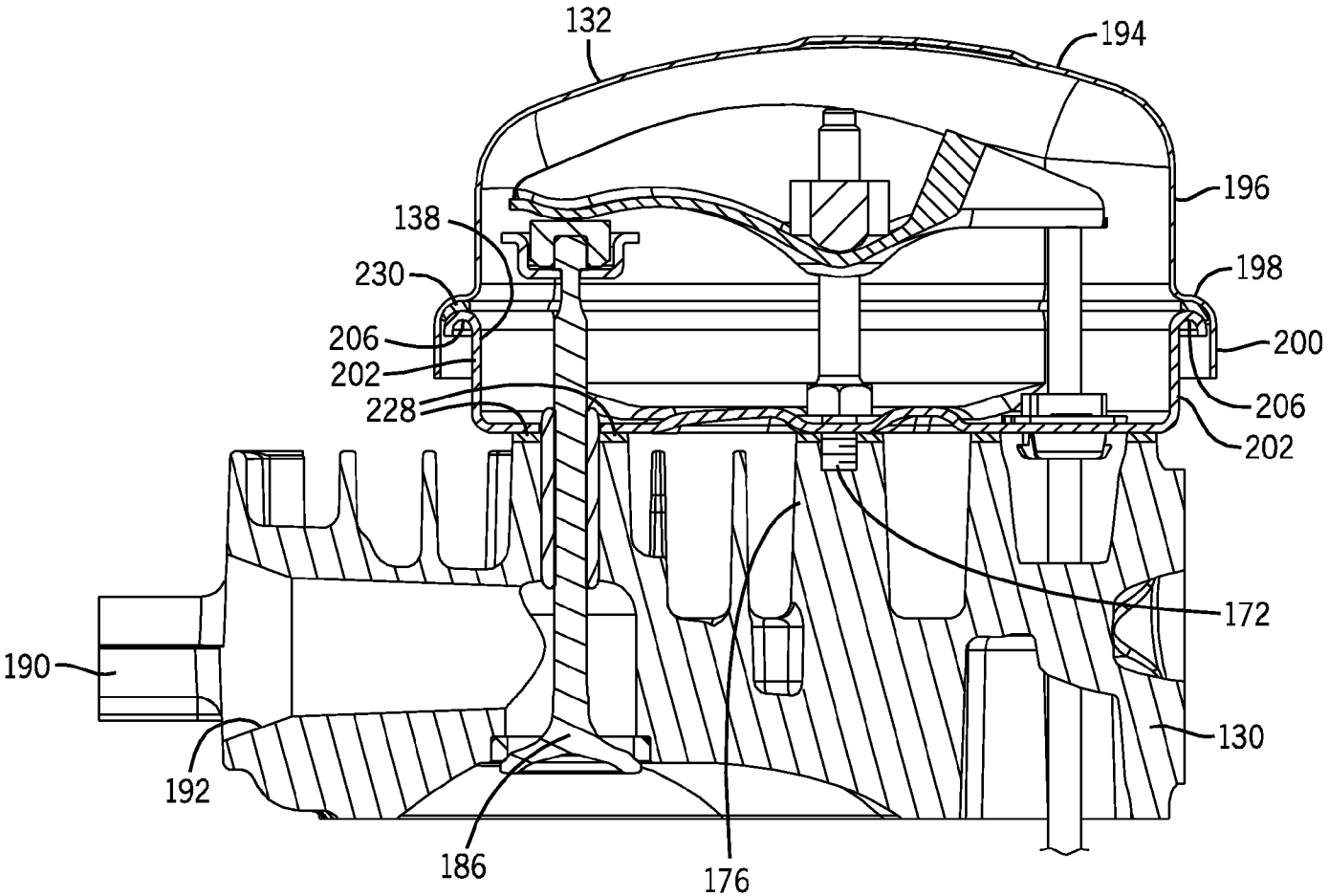
FIG. 5B is a sectional view taken generally along line 5B-5B of FIG. 2.

Referring to FIG. 5B, the mounting configuration of the rocker cover 132 and the head plate 138 is shown. The sides 202 of the head plate 138 terminate in a curl, shown as a rounded curl 206. The flange 198 of the rocker cover 132 rests on the top of the curl 206, and the overhang 200 extends over the side of the curl 206, and the overhang 200 attaches to the curl 206. In one embodiment, a solid or liquid gasket 230 is inserted between the curl 206 and the flange 198. One exemplary gasket material includes a room temperature vulcanizing silicone rubber. In other embodiments gaskets are formed from other commercially available gasket materials.

Figure 6C:
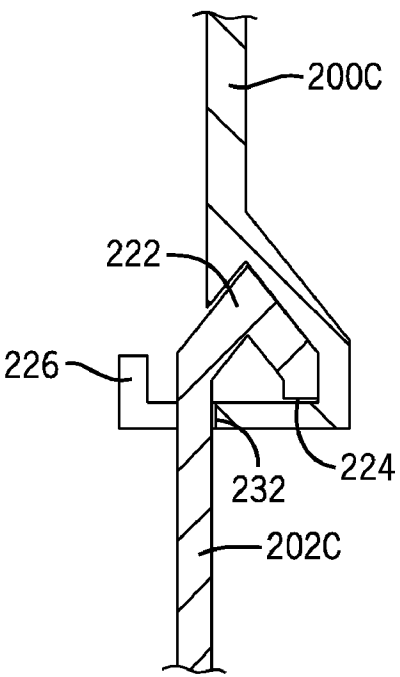
FIG. 6C is a sectional view of a fastener according to yet another exemplary embodiment.
Figure 6B:
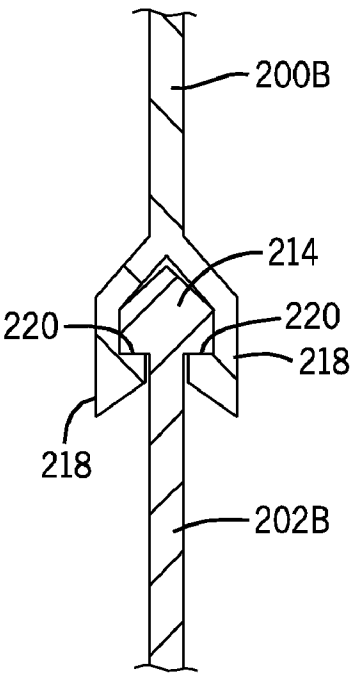
FIG. 6B is a sectional view of a fastener according to another exemplary embodiment.
Figure 6A:
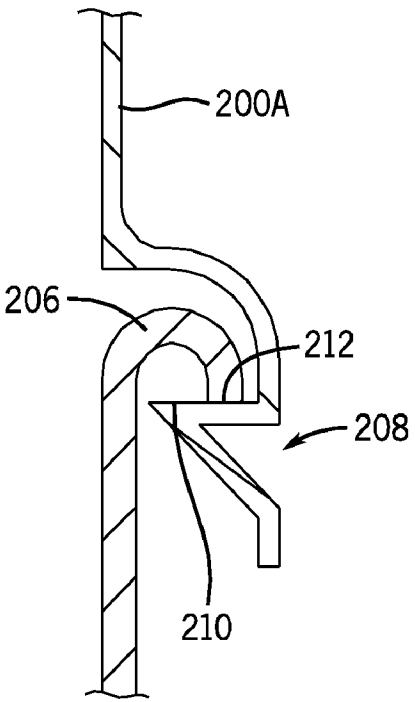
FIG. 6A is a sectional view of a fastener according to an exemplary embodiment.

FIGS. 6A-6C show various arrangements in which the overhang 200 may fasten to the curl 206. In FIG. 6A, the overhang 200A includes a protrusion 208 (see also FIG. 5A) that forms a catch. The protrusion 208 extends inside the side 196 and forms a ledge 210 or hook, which catches the end 212 of the curl 206. The combination of the protrusion 208 and the curl 206 allows the rocker cover 132 to "snap" onto the head plate 138. In FIG. 6B, a curl 214 extends both inside and outside of the sides 202B of the head plate 138. A fastener 216 integral with the overhang 200B extends over the curl 214, such that hooks 218 fasten to the underside 220 of the curl 214. The hooks 218 also form a catch. In FIG. 6C, a curl 222 engages a ledge 224 of the overhang 200C. The curl 222 has a triangular cross section. The ledge 224 further includes a hook 226 that extends through an aperture 232 in the sides 202C of the head plate 138. The ledge 224 and hook 226 form yet another catch. The fasteners of FIGS. 6A-6C can be detached by lifting the catch away from the end of the head plate 138, and lifting the rocker cover 132 away.

In some embodiments, multiple fasteners are used to couple the rocker cover 132 to the head plate 138. For example, in at least one embodiment overhang 200 of the rocker cover 132 includes at least two fasteners, each having a catch. The fasteners are positioned on opposing sides of the overhang 200. In another embodiment, the overhang 200 includes at least two fasteners. In some embodiments, the hook or catch is integral with the head plate 138 and is received by the overhang 200. The fasteners, as shown in FIGS. 6A-6C, allow for the coupling of the rocker cover 132 and the head plate 138 without the use of additional threaded fasteners (e.g., screws, bolts, etc.). While FIGS. 6A-6C disclose various forms of fasteners having a catch, other fasteners integral with the rocker cover and the head plate are used with other embodiments. For example, some embodiments include latches, pins, crimping, adhesives, spot welding, and other fasteners.

A method for assembling a rocker cover system includes several steps. A step includes providing the rocker cover 132, the head plate 138, the cylinder head 130, and the gasket 230. Another step includes fastening the head plate 138 to the cylinder head 130. A set includes coupling the gasket 230, such as a liquid gasket, to the curl 206 or to the flange 198. Yet another step includes aligning the rocker cover 132 over the head plate 138, such that the flange 198 and the overhang 200 are positioned over the curl 206. Another step includes pressing the rocker cover 132 toward the head plate 138 to "snap" the catch of the protrusion 208 into place at an end of the curl 206. No tools (e.g., screwdriver, pliers, wrench, etc.) are required.

The construction and arrangements of the system for covering rocker arms, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example the engine is shown with a vertical crankshaft, but it may be configured with a horizontal crankshaft. Also, the engine may include multiple cylinders. In some embodiments, the cover system is used to cover an overhead cam. Some elements shown as integrally formed may be constructed of multiple parts or elements, the position of elements may be reversed or otherwise varied, and the nature or number of discrete elements or positions may be altered or varied. In some embodiments, the system can be used to cover other engine components, such as a filter of an air intake. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An internal combustion engine with an overhead valve configuration, the engine comprising:

a cylinder head;

an exhaust valve rocker stud with a threaded end;

an intake valve rocker stud with a threaded end;

a head plate fastened to the cylinder head with the exhaust valve rocker stud and the intake valve rocker stud; and a cover for the head plate adapted to be snapped onto the head plate without the use of threaded fasteners;

wherein the cover and head plate enclose the exhaust valve rocker stud and the intake valve rocker stud when the cover is snapped onto the head plate; and wherein the only threaded fasteners fastening the head plate to the cylinder head are the rocker studs.

2. The engine of claim 1, further comprising a gasket positioned between the head plate and the cylinder head.

3. The engine of claim 2, further comprising two bosses extending from the cylinder head, wherein the exhaust valve rocker stud and the intake valve rocker stud fasten to bosses.

4. An internal combustion engine with an overhead valve configuration, the engine comprising:

a cylinder head having a plurality of mounting bosses extending therefrom;

two rocker studs;

a head plate fastened to the cylinder head via the rocker studs, wherein threaded ends of the rocker studs are fastened through apertures in the head plate to the mounting bosses; and a cover adapted to be snapped to the head plate without the use of threaded fasteners.

5. The engine of claim 4, wherein the cover comprises sides extending from a top surface and terminating in a flange with an overhang, the overhang comprising a catch, and wherein the head plate comprises sides extending from a bottom surface and terminating in a curl, wherein the flange and the overhang are positioned adjacent to the curl with the catch holding an end of the curl.

6. The engine of claim 5, wherein the head plate and the cover are asymmetrically shaped.

7. The engine of claim 6, wherein the catch comprises a protrusion extending from an inside surface of the overhang, the protrusion forming a ledge for engaging the end of the curl.

8. The engine of claim 7, wherein the curl is at least one of an arc, a square, or a triangular cross-section.

9. The engine of claim 8, further including a first liquid gasket positioned between the head plate and the cylinder head, and a second liquid gasket positioned between the curl and the flange overhang.

* * * * *